US006318357B1

(12) United States Patent
Mühle et al.

(10) Patent No.: US 6,318,357 B1
(45) Date of Patent: Nov. 20, 2001

(54) GAS BURNER CONFIGURATION FOR COOKING AREAS

(75) Inventors: Bernd Mühle, Kirchanschöring; Werner Gronnenberg; Jörn Naumann, both of Hagen, all of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/661,069

(22) Filed: Sep. 13, 2000

Related U.S. Application Data

(63) Continuation-in-part of application No. 09/220,244, filed on Dec. 23, 1998, now abandoned.

(30) Foreign Application Priority Data

Dec. 23, 1997 (DE) ..... 197 57 733

(51) Int. Cl.[7] ..... F23D 14/58

(52) U.S. Cl. ..... 126/39 R; 126/39 E; 431/284; 137/625.12; 137/905

(58) Field of Search ..... 126/39 N, 39 K, 126/39 J, 39 E, 39 R; 431/60, 264, 255, 278, 280, 284; 137/625, 625.12, 905

(56) References Cited

U.S. PATENT DOCUMENTS

| | | | |
|---|---|---|---|
| 2,146,660 | | 2/1939 | Swartz . |
| 2,162,233 | | 6/1939 | Schoenberger . |
| 2,201,077 | | 5/1940 | Browning . |
| 2,298,771 | | 10/1942 | Lamar . |
| 2,509,679 | * | 5/1950 | Evans ..... 137/625 |
| 2,781,779 | * | 2/1957 | Kindl ..... 137/625 |
| 2,871,930 | | 2/1959 | Drow . |
| 3,606,612 | | 9/1971 | Reid, Jr. . |

* cited by examiner

*Primary Examiner*—Ira S. Lazarus
*Assistant Examiner*—Sara Clarke
(74) *Attorney, Agent, or Firm*—Herbert L. Lerner; Laurence A. Greenberg; Werner H. Stemer

(57) ABSTRACT

A gas burner configuration for cooking areas includes a multi-ring gas burner having an inner burner with laterally aligned gas/air mixture outlet openings and an annular outer burner, disposed at a spacing from the inner burner, with gas/air mixture outlet openings. A hand-operated gas fitting directs, meters, and shuts off the combustion gas, which can be fed to the multi-ring burner through separate pipelines. The gas fitting has valves and three gas duct branches to be opened and closed by the valves using an operating member adjustable to different setting positions. Two of the branches each provide a constant gas throughput, and the third provides variable gas throughput. One of the constant gas throughput branches is associated with the inner burner and is opened by one valve over and entire actuating path of the operating member. The other of the constant gas throughput branches and the variable throughput branch are associated with the outer burner and opened by other valves. Thus, the inner burner is supplied through the fitting with a constant gas feed, while the outer burner can be supplied with a constantly metered gas feed for minimum power and with a variable gas feed for additional powers up to maximum power, by varying a duct path in the fitting.

10 Claims, 5 Drawing Sheets

GAS BURNER CONFIGURATION FOR COOKING AREAS

CROSS-REFERENCE TO RELATED APPLICATION

This application is a continuation-in-part of application Ser. No. 09/220,244, filed Dec. 23, 1998, now abandoned.

BACKGROUND OF THE INVENTION

Field of the Invention

The invention relates to a gas burner configuration for cooking areas. The configuration includes a multi-ring gas burner equipped with an inner burner having lateral gas/air mixture outlet openings and low combustion power. The configuration also includes an annular outer burner, disposed spaced from the inner burner, with gas/air mixture outlet openings, and a hand-operated gas fitting for directing, metering, and shutting off the combustion gas, which can be fed to the multi-ring burner through separate pipelines.

Such gas burner configurations are usually applied in heating, warming, and preparing meals, especially where there is a requirement for high heating power. Heating powers of up to 5 kW and above can be achieved with multi-ring burners so constructed. In particular, such burners are suitable as wok burners. Multi-ring gas burners are also used for achieving a greater control bandwidth by switching on and off individual burner rings having a variable heating power.

SUMMARY OF THE INVENTION

It is accordingly an object of the invention to provide a gas burner configuration for cooking areas that overcomes the hereinafore-mentioned disadvantages of the heretofore-known devices of this general type and that has a high functional reliability, is easily operable, and has a simple structure, as well as having a heating power that is suitable, in particular, for use as a wok burner. Wok burners used, for example, in Chinese households most commonly have a nominal heating power, that is to say a maximum heating power of 4 to 6 kW.

With the foregoing and other objects in view there is provided, in accordance with the invention, a gas burner configuration for cooking areas, having a multi-ring gas burner including an inner burner with lateral gas/air mixture outlet openings and low combustion power, and an annular outer burner disposed at a spacing from the inner burner and having gas/air mixture outlet openings, a hand-operated gas fitting for directing, metering, and shutting off combustion gas to be fed to the multi-ring burner through separate pipelines, the hand-operated gas fitting having valves, an operating member with an actuating path adjustable to a plurality of setting positions and intermediate positions for the valves, and three gas duct branches to be opened and closed by the valves with the operating member, two of the three gas duct branches each opening for a permanently prescribed gas throughput, and a further one of the three gas duct branches constructed for a variable gas throughput to be influenced by the operating member and an associated one of the valves, one of the two gas duct branches having a permanently prescribed gas throughput associated with the inner burner and opened by an associated one of the valves over the entire actuating path starting from a zero position, possibly after a preliminary path of an operating member setting, and another two of the three gas duct branches associated with the outer burner and activated by the valves associated therewith through a segment of the actuating path keeping the first of the two gas duct branches open.

In accordance with another feature of the invention, the gas duct branches associated with the outer burner are activated through a final segment of the actuating path of the operating member, keeping one of the two gas duct branches open through its valves, and in an initial position of the final segment, the valve for the gas duct branch with the variable gas throughput is fully opened and has a final position in which the valve for the gas duct branch with variable gas throughput is closed.

The gas burner configuration according to the invention is, therefore, distinguished by a simple structure that can be operated in a user-friendly way in conjunction with a high maximum combustion power and a relatively low minimum combustion power. The inner burner, which is to be operated at constant power, can be constructed, for example, for a power of between 300 W and 500 W, and serves both as a burner for the lowest combustion power and, preferably, as an ignition burner.

In accordance with a further feature of the invention, an ignition element is disposed in the vicinity of the inner burner, and it is possible to actuate the ignition element by a piezoelectric current-voltage sensor or by an electronic current-voltage sensor, depending on the form of the gas burner configuration (according to the invention) used. The use of a piezoelectric current-voltage sensor is preferred more readily in portable gas burner units in which an external power supply is not ensured.

In accordance with an added feature of the invention, there is provided a thermocouple in the vicinity of the inner burner which serves, if appropriate, as a flame monitoring element and acts on a closure element in the gas fitting to interrupt the gas feed to the burner when the flame at the inner burner extinguishes.

The outer burner can be constructed, for example, for a maximum power of 5,000 W. It is possible for the maximum power of the outer burner to be controlled downward by approximately 1,000 W by gas feed throttling. Through gas duct branches in the gas fitting, both the gas feed for powering the inner burner and the gas feed for minimally powering the outer burner are metered as given values. The configuration ensures high combustion reliability in the overall structure of the burner even when having low power values. The maximum burner power is achieved by using an additional third duct branch in the fitting, which can be variably set up to the maximum value depending on the wishes of the operator.

In accordance with an additional feature of the invention, the required gas injector nozzle configuration, in the vicinity of which the combustion gas is mixed with the primary air, for the inner burner, is disposed directly in the burner head, while the corresponding gas injector nozzle configuration for the outer burner is disposed in the vicinity of the gas fitting. In the example of the inner burner having relatively low heating power, the mixing path between the lower part of the burner head, in which the gas injector nozzle configuration is provided, to the combustion site, suffices for good flame formation. In contrast, for a very high maximum power of the outer burner, in order to arrive at a good and uniformly-distributed mixing ratio of gas and primary air, it is advantageous and necessary for thorough mixing of the strong gas current from the injector nozzle with the air drawn in thereby from the surroundings to provide a longer path between the gas injector nozzle configuration and the combustion site. Preferably, thorough mixing can be realized by virtue of the fact that the gas injector nozzle is further constructed as a component of the gas fitting, which is aligned with the open inlet of the feed duct for the gas/air mixture of the outer burner. The configuration also leads to an expedient mechanical decoupling of the burner unit and fitting in this region.

Other features that are considered as characteristic for the invention are set forth in the appended claims.

Although the invention is illustrated and described herein as embodied in a gas burner configuration for cooking areas, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
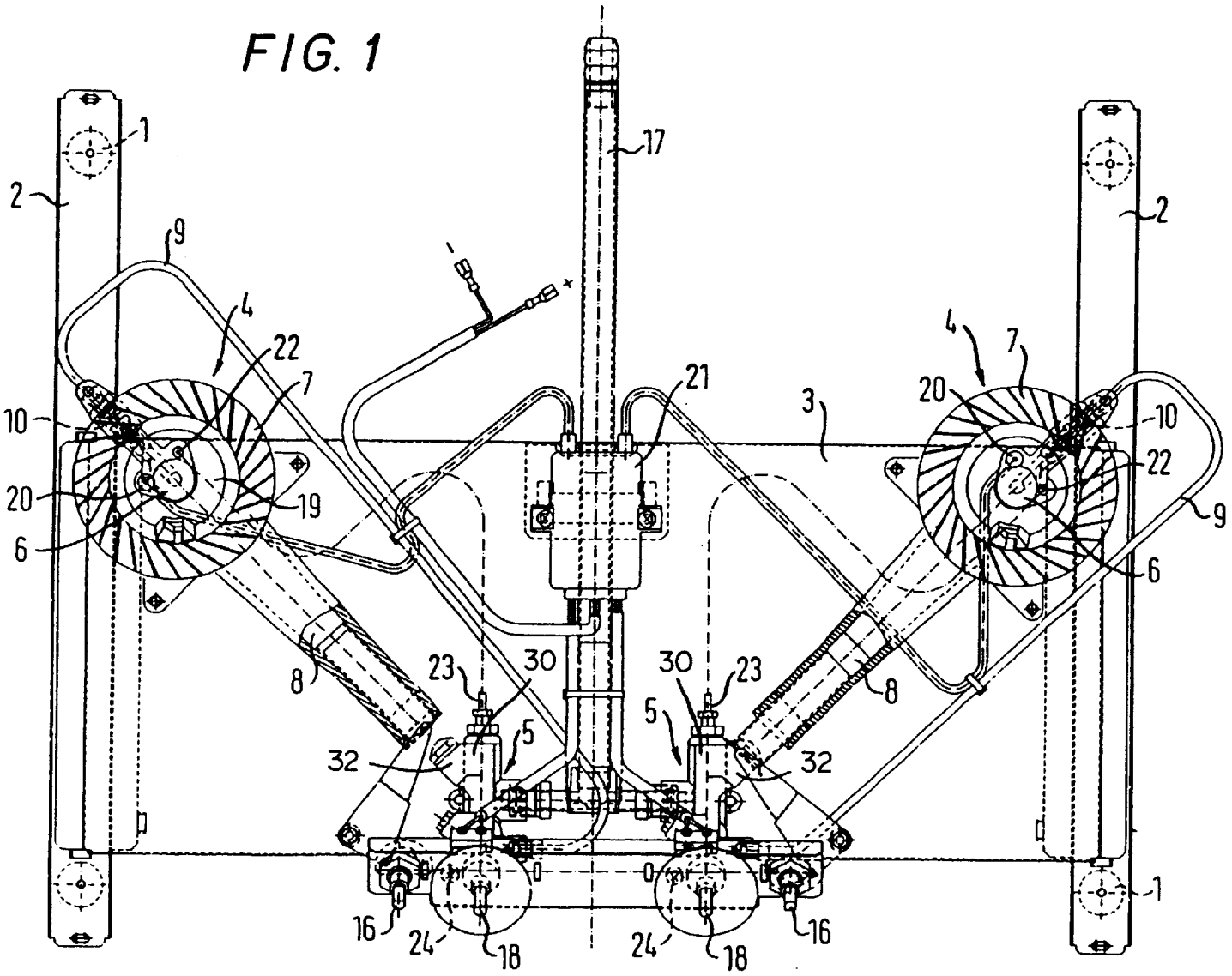
FIGS. 1 and 2 are diagrammatic, plan views of configurations according to the invention each having two cooking areas and an associated burner fitting, without an associated housing and without an associated cover with pot supporting units.
Figure 2:
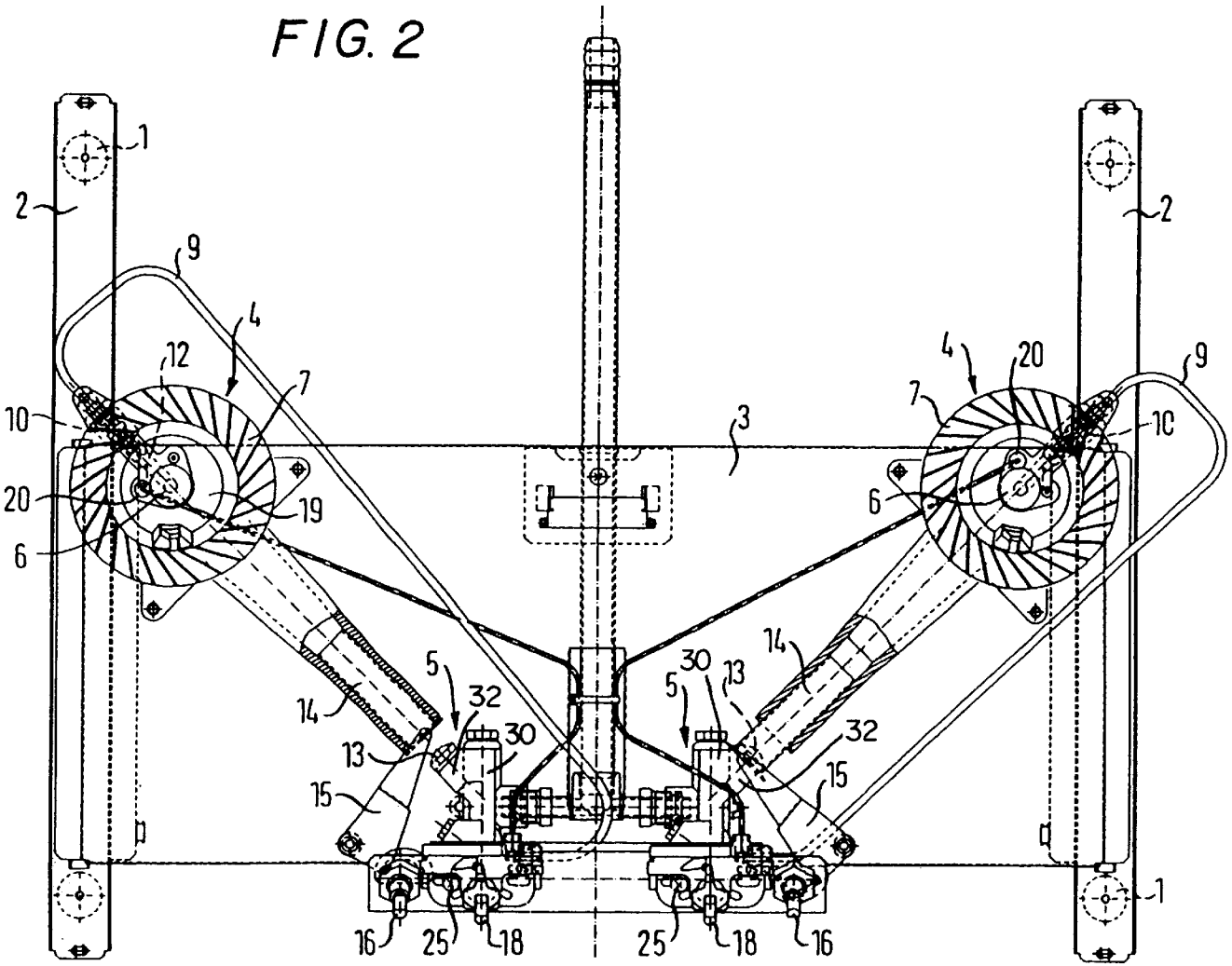
Figure 3:
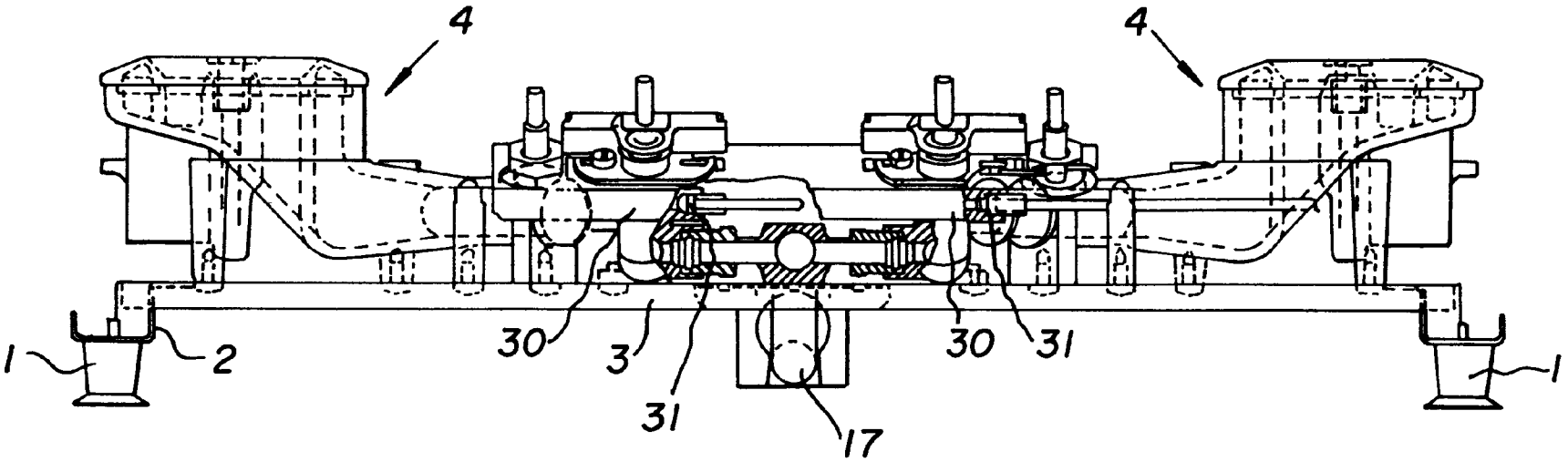
FIG. 3 is a front-elevational view of such a configuration.

Referring now to the figures of the drawings in detail and first, particularly, to FIGS. 1 and 2 thereof, there are seen gas burner configurations or heads 4 and associated gas fittings 5 for two cooking areas that are fastened on a basic frame including two angle strips 2 fitted with feet 1 and a baseplate 3 situated therebetween. The gas burner configurations 4, which are of completely similar structure, each have two burner rings, specifically, an inner burner 6 and an outer burner 7 disposed around the inner burner 6. The gas burner configurations 4 are aligned in a V-shape with respect to a feed duct direction of the gas fittings 5, the feed duct for gas/air mixture intended for the outer burner 7. A connection for a gas line 9 is provided in a plane perpendicular to a gas/air feed duct 8 for the outer burner 7 in an oppositely disposed manner in a lower region of the burner head of each of the gas burner configurations 4. The gas line 9 departs from a respective fitting 5 and leads to a gas injector nozzle configuration 10 disposed in the burner head of the gas burner configuration 4. An intake of primary air to the gas injector nozzle configuration is cleared through an opening 11 on the underside of the burner head (see FIG. 6). The gas mixes with primary air in a duct 12 leading to the inner burner 6 to form a mixture that burns well. Secondary air required for the inner burner 6, as well as a necessary partial quantity of secondary air for the outer burner 7, passes to flame regions through a clearance opening 19 between the inner burner 6 and the outer burner 7.

The gas emerging from the fitting 5 is blown into the gas/air feed duct 8 through a gas nozzle 13 (see FIGS. 7A to 7D), which is a constituent of the fitting member, although primary air is entrained. An intensive mixing of gas blown in and air inducted toward the outer burner 7 takes place in the gas/air feed duct 8, which has an adequate length.

Figure 4:
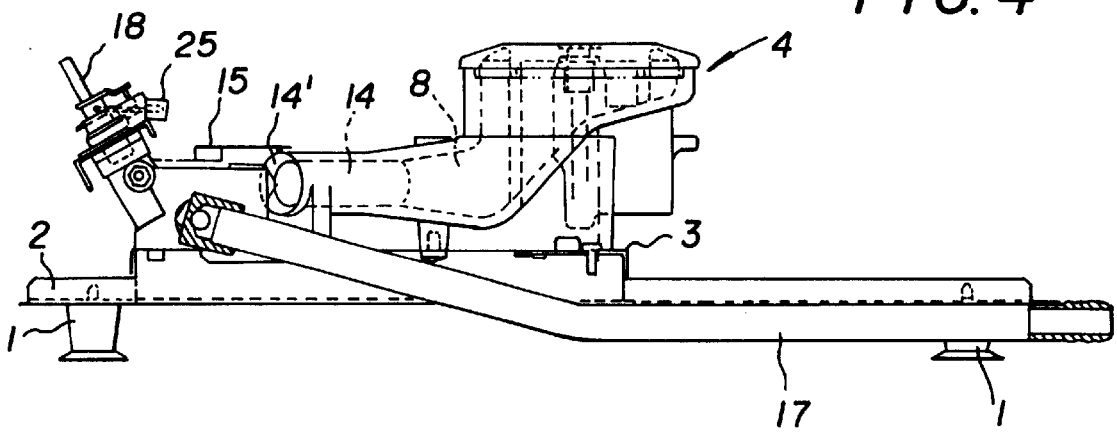
FIGS. 4 to 6 are partially sectional, side-elevational views of burner units.
Figure 5:
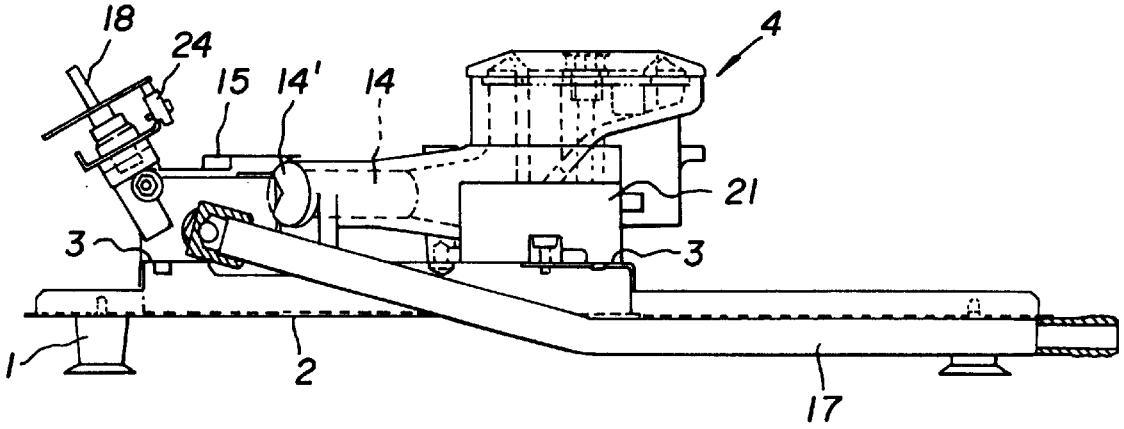
Figure 6:
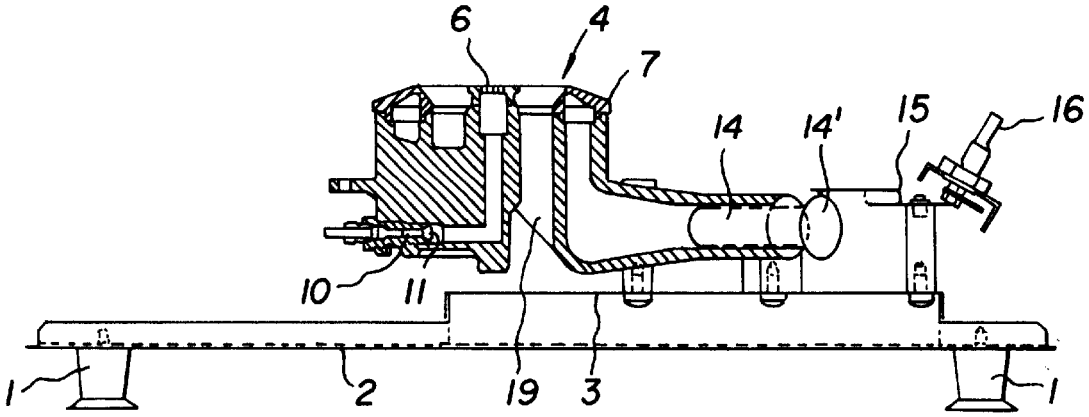
Figure 7A:
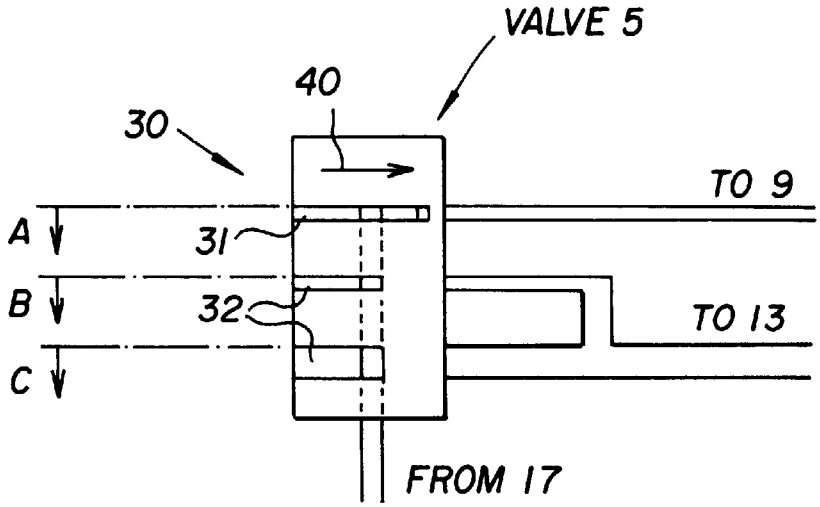
FIG. 7A is a diagrammatic, cross-sectional plan view of a valve according to the invention.
Figure 7B:
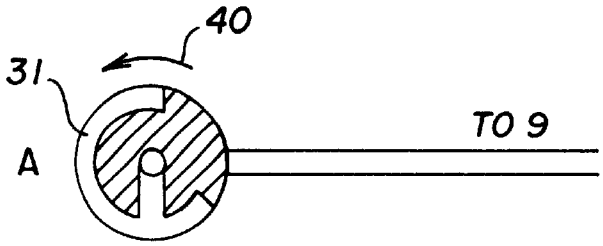
FIGS. 7B to 7D are diagrammatic, cross-sectional top views of the valve of FIG. 7A along cuts A, B and C, respectively.
Figure 7C:
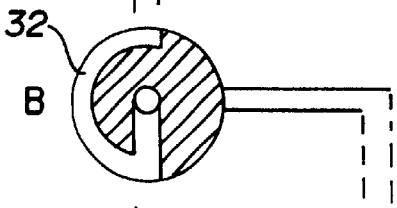
Figure 7D:
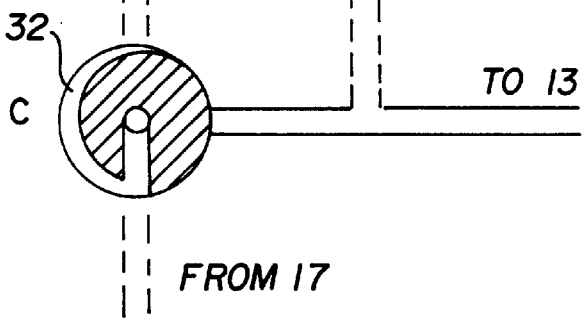

As is seen in FIGS. 4 to 6, in order to adapt the air feed individually to the rate of outflow and type of gas being used, an inlet opening of the gas/air feed duct 8 is associated with an axially displaceable pipe connector 14 having an induction funnel 14', through which an effective spacing of the gas/air feed duct 8 toward the nozzle 13 can be varied. As a result thereof, the air induction can also be varied. The pipe connector 14 can be actuated by an angle lever 15 mounted in the baseplate 3 by using a finger-grip knob configuration 16 having a non-illustrated actuating knob that projects from a likewise non-illustrated operating panel.

A gas feed for the gas burner configurations 4 of the two cooking areas of a cooker hob or cooktop platform is performed centrally through a gas line 17. The gas line 17 is connected to the two fittings 5 in a branched manner like a "T" between the two fittings 5 (see FIGS. 1 and 2). The two fittings 5 are constructed and disposed symmetrically relative to one another. They each contain three gas duct branches 30 which can be opened and closed by a finger-grip knob configuration 18, through a non-illustrated actuating knob projecting above the operating panel. See FIG. 7A. One of the gas duct branches 31 in the fitting 5 is constructed for constant gas throughput and is associated with the inner burner 6 through the gas feed line 9. See FIGS. 7A and 7B. After an initial rotary movement 40 of the finger grip knob configuration 18, this gas duct branch 31 is fully opened, specifically, for the entire further adjustment path of this finger-grip knob configuration 18. The flame at the inner burner 6 can also be ignited in the initial position, in which this gas duct branch 31 is open. An igniting electrode 20 is disposed in the vicinity of the inner burner 6 for such ignition. An ignition voltage for generating an igniting spark is generated in the embodiment according to FIGS. 1 and 5 with an ignition generator 21 activated by a contact 24 that can be actuated by the finger-grip knob configuration 18, for example, by pressing the knob in axially. For the embodiment according to FIGS. 2 and 4, the finger-grip knob configuration 18 acting upon a piezoelectric element 25 generates an ignition. Ignition occurs because a striking movement is exerted on the piezoelectric element 25 at the instant when the gas duct branch 31 is opened, which is accomplished by a preliminary rotary movement or pressing-in movement of the finger-grip knob configuration 18.

As may be seen from FIG. 1, a thermocouple 22 is also disposed in the vicinity of the inner burner 6, if required. A main valve 23 for the exit of gas is held open by the thermocouple 22, as long as the flame is present at the inner burner 6.

After a further angle of rotation, after which the first gas duct branch 31 is open for the inner burner 6 and the flame has been ignited at the inner burner, two further gas duct branches 32 are completely opened. See FIGS. 7C and 7D. The further gas duct branches 32 are associated with the nozzle 13 and, thus, with the outer burner 7 of each of the gas burner configurations 4. The flame of the outer burner is ignited from the flame of the inner burner 6. One of the two gas duct branches 32 associated with the outer burner 7 and led to the gas nozzle 13 is variable with reference to the gas flow rate (see FIGS. 7A and 7D), and can be completely closed by the end of a prescribed angle of rotation of the finger-grip knob configuration. The second of the gas duct branches 32 leading to the gas nozzle 13 remains fully open during this time and serves to ensure that gas is fed to the outer burner 7 to supply the minimum heating power. See FIGS. 7A and 7C.

The structure and configuration of the gas burners for the two cooking areas are conceived and selected to make the components for the two cooking area units be as simple and as similar as possible. The gas fittings 5 and their associated adjusting mechanisms for adding air in the region of the nozzles 13 are constructed as mirror images and correspond to each other as much as possible. The structure of the two-ring gas burner configurations 4 is completely identical. Such a structure permits the actuating elements for the separately situated cooking area regions to be moved near one another on the front operating panel and to form an actuating block.

We claim:

1. A gas burner configuration for cooking areas, comprising:

a multi-ring gas burner including an inner burner with lateral gas/air mixture outlet openings and low combustion power, and an annular outer burner disposed at a spacing from said inner burner and having gas/air mixture outlet openings;

a hand-operated gas fitting for directing, metering, and shutting off combustion gas to be fed to said multi-ring burner, said hand-operated gas fitting having valves, an operating member with an actuating path adjustable to a plurality of setting positions and intermediate positions for said valves, and three gas duct branches to be opened and closed by said valves with said operating member;

two of said three gas duct branches each opening for a given gas throughput, and a further one of said three gas duct branches constructed for a variable gas throughput to be influenced by said operating member and an associated one of said valves;

one of said two gas duct branches having a given gas throughput associated with said inner burner and opened by an associated one of said valves over said entire actuating path starting from a zero position; and another two of said three gas duct branches associated with said outer burner and activated by said valves associated therewith through a segment of said actuating path keeping said one of said two gas duct branches open.

2. The gas burner configuration according to claim 1, wherein said actuating path includes a preliminary path and said gas duct branch associated with said inner burner is opened after said operating member has been actuated along said preliminary path.

3. The gas burner configuration according to claim 1, wherein said gas duct branches associated with said outer burner are to be activated through a final segment of said actuating path of said operating member, keeping said one of said two gas duct branches open through said valves, and said final segment has an initial position in which said valve for said gas duct branch with variable gas throughput is fully opened and has a final position in which said valve for said gas duct branch with variable gas throughput is closed.

4. The gas burner configuration according to claim 1, including an ignition device having an ignition element disposed in a vicinity of said gas/air mixture outlet openings of said inner burner.

5. The gas burner configuration according to claim 4, wherein said ignition device contains a piezoelectric current peak/voltage sensor.

6. The gas burner configuration according to claim 5, including a striking mechanism actuating said piezoelectric current peak/voltage sensor, said gas duct branch associated with said inner burner opening after a preliminary path of an operating member setting, and said striking mechanism loaded after surmounting said preliminary path and released at a start of said actuating path keeping said gas duct branch to said inner burner open.

7. The gas burner configuration according to claim 4, wherein said ignition device contains an electronic current peak/voltage sensor to be activated by a switch operable by pressing-in axially said operating member.

8. The gas burner configuration according to claim 1, including a heat sensor disposed in a flame region of said inner burner, said heat sensor ensuring a set gas feed to said burners through said gas fitting even apart from actuation of said operating member in an axial insertion direction.

9. The gas burner configuration according to claim 1, including a burner head with a lower part, and a gas injector/nozzle configuration for said inner burner disposed in said lower part of said burner head.

10. The gas burner configuration according to claim 1, including a gas nozzle associated with said gas fitting, and a burner head incorporating said inner burner and said outer burner, said outer burner having a gas/air feed duct with an inlet opening and a gas injector/nozzle configuration disposed in a vicinity of said gas fitting, said gas nozzle being aligned centrally with said inlet opening of said gas/air feed duct.

* * * * *